US007044794B2

(12) United States Patent
Consoli et al.

(10) Patent No.: US 7,044,794 B2
(45) Date of Patent: May 16, 2006

(54) ELECTRICAL CONNECTOR WITH ESD PROTECTION

(75) Inventors: John Joseph Consoli, Harrisburg, PA (US); Brent Ryan Rothermel, Harrisburg, PA (US); Graham Harry Smith, Jr., Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 6 days.

(21) Appl. No.: 10/891,211

(22) Filed: Jul. 14, 2004

(65) Prior Publication Data

US 2006/0014433 A1 Jan. 19, 2006

(51) Int. Cl.
*H01R 13/648* (2006.01)

(52) U.S. Cl. ..... 439/608; 439/924.1

(58) Field of Classification Search ..... 439/607, 439/608, 924.1, 951
See application file for complete search history.

(56) References Cited

U.S. PATENT DOCUMENTS

| | | | | |
|---|---|---|---|---|
| 4,571,014 | A | 2/1986 | Robin et al. | |
| 5,746,622 | A | 5/1998 | Consoli et al. | 439/521 |
| 6,083,047 | A | 7/2000 | Paagman | 439/608 |
| 6,641,438 | B1 * | 11/2003 | Billman | 439/608 |
| 6,808,399 | B1 * | 10/2004 | Rothermel et al. | 439/108 |
| 6,808,419 | B1 * | 10/2004 | Korsunsky et al. | 439/607 |
| 6,884,117 | B1 * | 4/2005 | Korsunsky et al. | 439/607 |

* cited by examiner

*Primary Examiner*—Khiem Nguyen

(57) ABSTRACT

An electrical connector includes a dielectric housing that holds a plurality of electrical wafers. Each of the wafers includes a first side, a second side opposite the first side, and a forward mating edge. A plurality of contact pads on the first side are recessed from the forward mating edge, and a perimeter conductive trace is closer than the contact pads to the forward mating edge.

20 Claims, 5 Drawing Sheets

ELECTRICAL CONNECTOR WITH ESD PROTECTION

BACKGROUND OF THE INVENTION

This invention relates generally to electrical connectors, and more particularly, to a connector having electrostatic discharge (ESD) protection.

Some electrical connectors have a mating end wherein conductive terminals are exposed for engagement with the terminals of a mating connector. This is common in a right angled connector used for interconnecting circuit boards such as a back plane and a daughter board. The back plane typically has a connector, commonly referred to as a header, that mates with a daughter board connector, commonly referred to as a receptacle. Portions of the terminals in the receptacle are often exposed for engagement with the terminals of the header connector.

When mating the connectors, opposite charges at the connector interface may result in an electrostatic discharge between the two connectors. In fact, electrostatic discharges can be generated simply by a person approaching or touching the connector interface or touching the terminal contacts. Generally, very little current is associated with an electrostatic discharge; however, the voltage can be high enough to damage or destroy certain types of electrical devices such as semiconductor devices. Consequently, when the connector contacts or terminals are electrically associated with such devices on a circuit board, the electrostatic discharge may damage or destroy the electrical devices on the circuit board.

In order to alleviate the electrostatic discharge problem, some electrical connectors include features to provide ESD protection. In at least some connectors, ESD protection is provided with a shield in the form of a plate, bar, or the like located proximate the connector interface and connected to ground on or proximate the connector. However, the provision of such ESD shields add to the cost of the connector. Provision must be made in the connector housing for mounting the ESD shield and an ESD pathway must be provided to ground the shield. These structures also add to the cost and complexity of the connector.

In at least some right angled receptacle connectors, the receptacle includes a plurality of wafers, each of which includes signal carrying traces and ground traces along with signal and ground contact pads. Often, the contact pads and traces are confined to a front surface and a large ground plane is disposed on the rear surface for shielding purposes. Typically, the ground plane covers a substantial portion of the rear surface of the wafer; however, for signal integrity reasons, the ground plane does not generally extend to an area behind the contact pads. To effectively shield the connector, each of the wafers needs to be shielded from ESD.

A need remains for a connector that provides ESD shielding in a cost effective manner and without adding to the size or complexity of the connector.

BRIEF DESCRIPTION OF THE INVENTION

In one aspect, an electrical connector is provided. The connector includes a dielectric housing that holds a plurality of electrical wafers. Each of the wafers includes a first side, a second side opposite the first side, and a forward mating edge. A plurality of contact pads on the first side are recessed from the forward mating edge, and a perimeter conductive trace is closer than the contact pads to the forward mating edge.

Optionally, the perimeter conductive trace is connected to a ground plane on the second side. The perimeter conductive trace further includes secondary ground traces on the second side aligned with the ground contact pads on the first side. The secondary ground traces extend from the perimeter conductive trace to the ground plane on the second side of the wafer.

In another aspect, an electrical connector is provided that includes a dielectric housing including a mating face and a mounting face. A plurality of electrical wafers is held within the housing. Each wafer includes a first side, a second side opposite the first side, a mating end proximate the housing mating face, and a mounting edge proximate said housing mounting face. The mating end includes signal contact pads and ground contact pads on the first side of the wafer. An electrostatic discharge (ESD) shield is integrally formed on one of the first and second sides of each wafer.

In another aspect, an electrical wafer for a connector is provided. The electrical wafer includes a planar substrate having a first side and an opposite second side and first and second intersecting edges. A plurality of signal contact pads and ground contact pads are located on the first side and linearly arranged along the first and second edges. The first edge comprises a mating edge that defines a mating end. An electrostatic discharge (ESD) shield is integrally formed on one of the first and second sides, and the ESD shield is configured to receive an ESD.

DETAILED DESCRIPTION OF THE INVENTION

Figure 1:
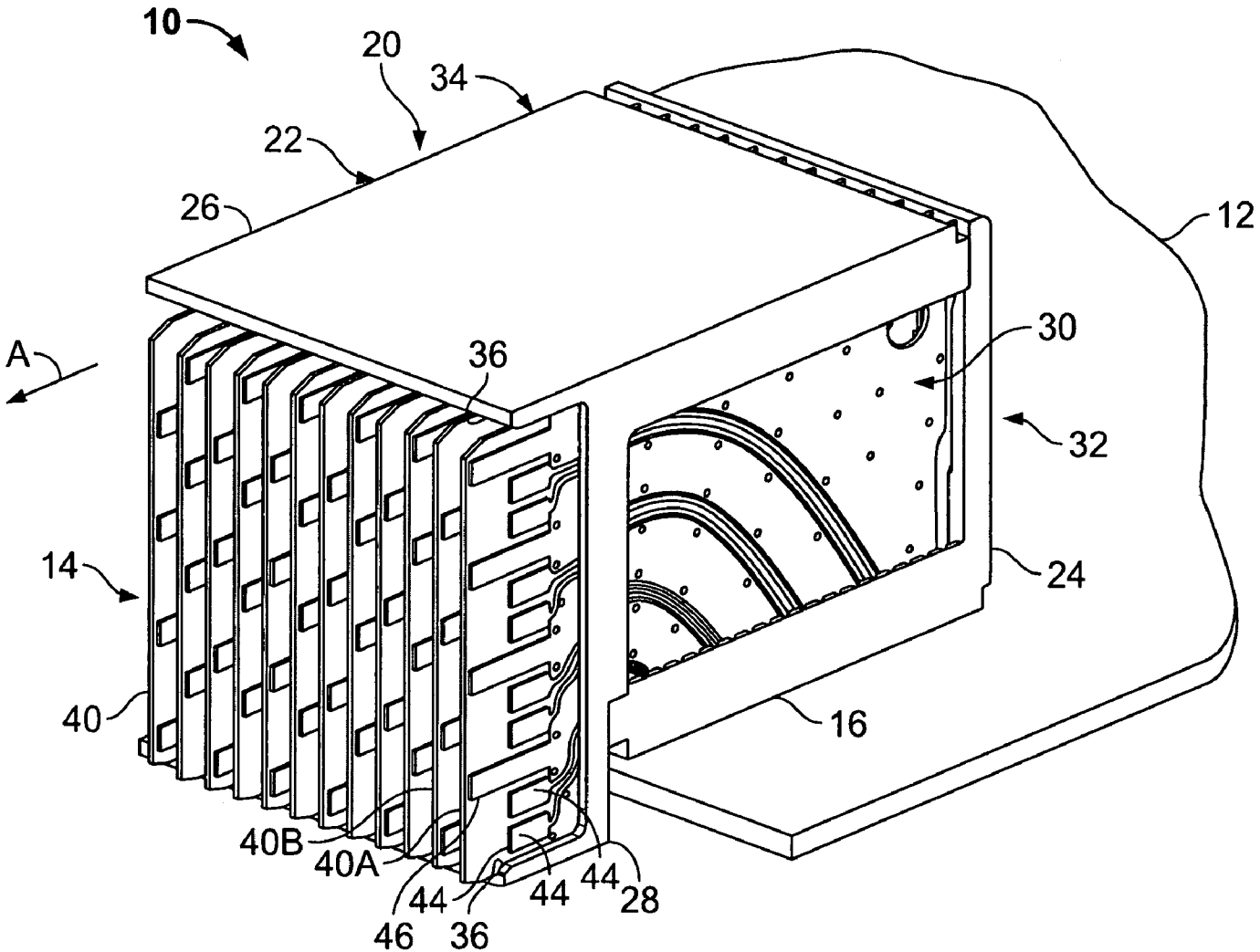
FIG. 1 is a perspective view of a receptacle connector formed in accordance with an exemplary embodiment of the present invention.

FIG. 1 illustrates a perspective view of an electrical connector 10 formed in accordance with an exemplary embodiment of the present invention. The connector 10 is a receptacle connector that is configured to be mounted on a circuit board 12 which in an exemplary embodiment is a daughter board. The connector 10 has a mating face 14 and a mounting face 16 that includes an interface for mounting the connector 10 to the circuit board 12. In an exemplary embodiment, the mounting face 16 is substantially perpendicular to the mating face 14 such that the receptacle connector 10 interconnects electrical components that are substantially at a right angle to each other. The mating face 14 of the connector 10 defines a back plane connector interface. In one embodiment, the connector 10 may be used to interconnect a daughter board to a back plane circuit board. In other embodiments, the connector 10 may be configured to interconnect electrical components that are at other than a right angle to each other.

While the invention will be described in terms of a connector carrying differential signals, it is to be understood that the following description is for illustrative purposes only and is but one potential application of the inventive concepts herein. It is appreciated that the benefits and advantages of the invention may accrue equally to other types of signal connectors and wafer combinations.

The connector 10 includes a dielectric housing 20 that has an upper housing portion 22 and a lower housing portion 24. The upper housing 22 includes upper and lower shrouds 26 and 28, respectively that are proximate the mating face 14 of the connector 10. Upper shroud 26 and lower shroud 28 extend forwardly from upper housing 22 in the direction of arrow A, which is also the mating direction of the connector 10. The housing 22 includes end openings 30 at a first end 32 and a second end 34. The upper housing 22 and lower housing 24 are coupled together forming an open framework for holding a plurality of wafers 40 that are received into the housing 20 with a card edge connection. The upper shroud 26 and lower shroud 28 each include a plurality of slots 36 that position and align the wafers 40 to facilitate mating with a mating connector (not shown in FIG. 1).

The wafers 40 include signal contact pads 44 and ground contact pads 46. The ground contact pads 46 have a length measured in the direction of arrow A that is greater than a corresponding length of the signal contact pads 44. In one embodiment, the connector 10 is a high speed connector that carries differential signals and the signal contact pads 44 and ground contact pads 46 are arranged in an alternating pattern wherein pairs of signal contact pads 44 are separated by a ground contact pad 46. For instance, the wafer 40A starts with a ground contact pad 46 adjacent the upper shroud 26 and ends with a pair of signal contact pads 44 adjacent the lower shroud 28 whereas the adjacent wafer 40B begins with a pair of signal contact pads 44 adjacent the upper shroud 26 and ends with a ground contact pad 46 adjacent the lower shroud 28. Due to their shorter lengths, the signal contact pads 44 on the wafer 40B are hidden by the wafer 40A in FIG. 1; however, the alternating nature of the pattern is revealed by the positioning of the ground contact pads 46. The pattern of signal and ground contact pads alternates from wafer to wafer in the connector 10. The connector 10 is modular in construction and in the embodiment shown in FIG. 1 includes twelve wafers 40 with a total of 48 differential signal pairs of contact pads. It is to be understood that in alternative embodiments, a greater or fewer number of the wafers 40 may be used. The wafers 40 project from the shrouds 26 and 28 and may be vulnerable to damage from an electrostatic discharge (ESD). One purpose of the ground contact pads 46 is to provide ESD protection for the signal contact pads 44.

Figure 2:
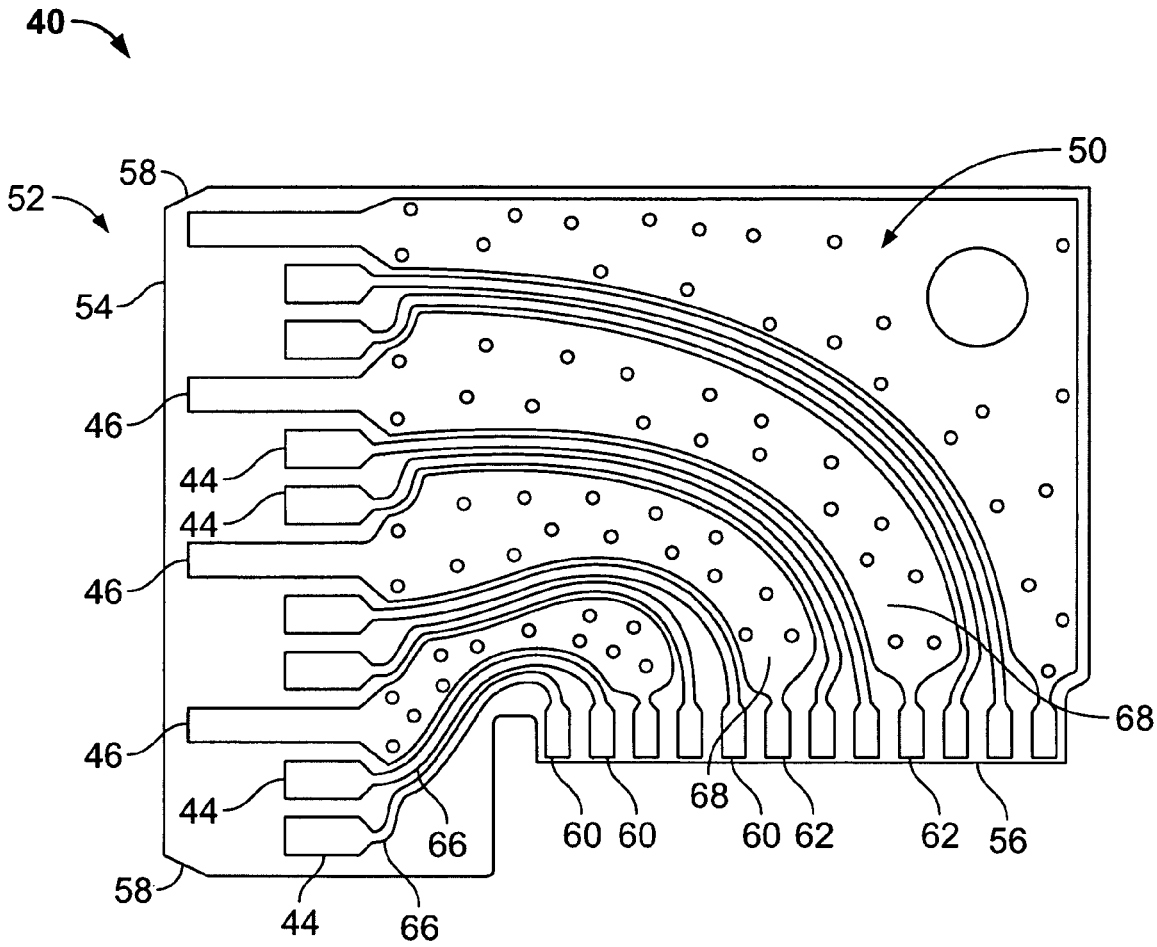
FIG. 2 is a front view of a wafer formed in accordance with an exemplary embodiment of the present invention.

FIG. 2 is a front view of an exemplary wafer 40 illustrating a wafer first side 50. The wafer 40 includes a mating end 52 that has a forward mating edge or back plane edge 54. The mating end 52 is configured to mate with a mating connector which may be a back plane connector (not shown in FIG. 2). The wafer 40 also includes a mounting edge or daughter board edge 56 that is received in the lower housing 24 (FIG. 1) at the interface with the circuit board 12 (FIG. 1). The mounting edge 56 is substantially perpendicular to the mating edge 54. The wafer 40 has chamfered corners 58 at the mating end 52 to facilitate the mating process with the mating connector.

In an exemplary embodiment, the wafer 40 is a printed circuit board wafer. The wafer 40 includes a number of signal and ground contact pads 44 and 46, respectively, arranged along the mating edge 54 and a number of signal contact pads 60 and ground contact pads 62 along the mounting edge 56. Due to their shorter length, the signal contact pads 44 are recessed rearwardly from the wafer mating edge 54 with respect to the ground contact pads 46. Conductive signal traces 66 interconnect the signal contact pads 44 and 60 on the mating edge and mounting edge 54 and 56, respectively. Ground contact traces 68 interconnect the ground contact pads 46 at the mating edge 54 of the wafer 40 with ground contact pads 62 at the mounting edge 56; however, there need not be a strict one-to-one relationship between ground contact pads 46 and 62, as will be explained. The wafer 40 has contact pads 44, 46, 60, and 62 and signal traces 66 only on the first side 50.

Figure 3:
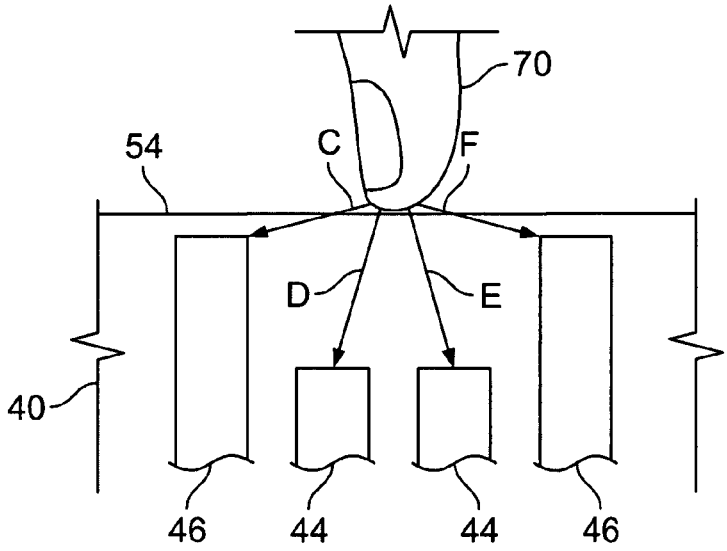
FIG. 3 is a partial front view of a wafer receiving an electrostatic discharge (ESD) from a fingertip.

FIG. 3 illustrates a partial front view of the wafer 40 receiving an electrostatic discharge (ESD) from the touch of a fingertip 70 to a central portion of the wafer mating edge 54. When an ESD occurs, the charge seeks the shortest path to a conductive object. If there is sufficient voltage or potential present, the ESD can jump an air gap to a conductive object. In FIG. 3, the fingertip 70 touches the mating edge 54 in line with the signal contact pads 44 and between the ground contact pads 46. Arrows C, D, E, and F represent the possible discharge paths. Arrows C and F are both shorter than either of arrows D or E so that if a discharge occurs, the discharge will go to a ground contact pad 46 and not a signal contact pad 44. Thus, in this situation, the ground contact pads 46 effectively shield and protect the signal contact pads 44 from damage from an ESD.

Figure 4:
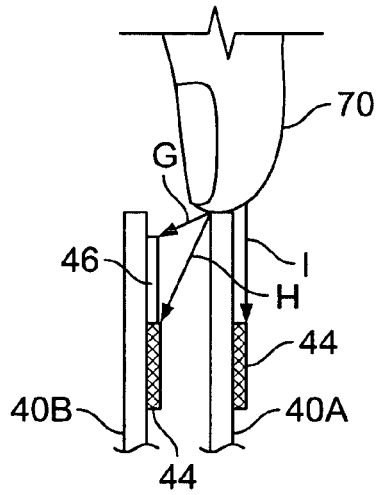
FIG. 4 is a partial end view of adjacent wafers receiving an ESD from a fingertip.

FIG. 4 illustrates a partial end view of adjacent wafers such as 40A and 40B (see FIG. 1) receiving an ESD from a fingertip 70. The fingertip 70 touches the wafer 40A in line with the signal contact pad 44. Potential discharge paths are represented by arrows G, H, and I. The arrow G to the longer ground contact 46 on the adjacent wafer 40B represents the shortest discharge path and is the path that will be taken if a discharge occurs. Here again, the ground contact pads 46 effectively shield and protect the signal contact pads 44 from damage from an ESD.

Figure 5:
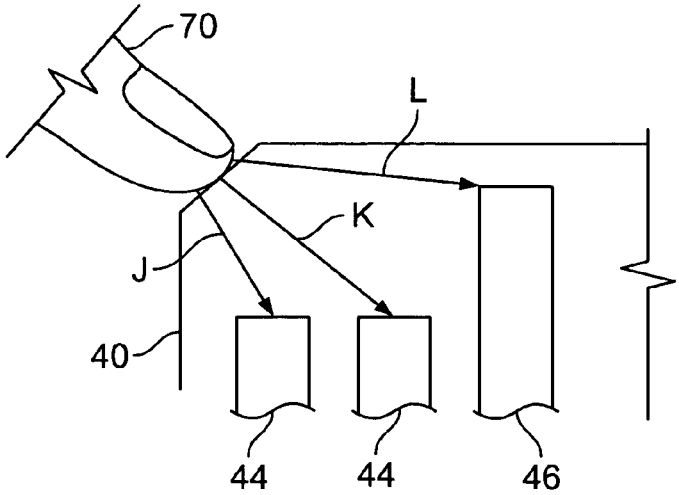
FIG. 5 is a partial front view of a wafer receiving an ESD from a fingertip at a chamfered corner of the wafer.

FIG. 5 illustrates a partial front view of the wafer 40 receiving an ESD from a fingertip at the chamfered corner 58 of the wafer 40. In the situation shown, possible discharge paths for an ESD are represented by the arrows J and K leading to signal contact pads 44 and the arrow L leading to the ground contact pad 46. In this scenario, the discharge path L to the ground contact pad 46 is longer than the discharge paths J and K to the signal contact pads 44 so that the signal path is vulnerable to damage from an ESD.

Figure 6:
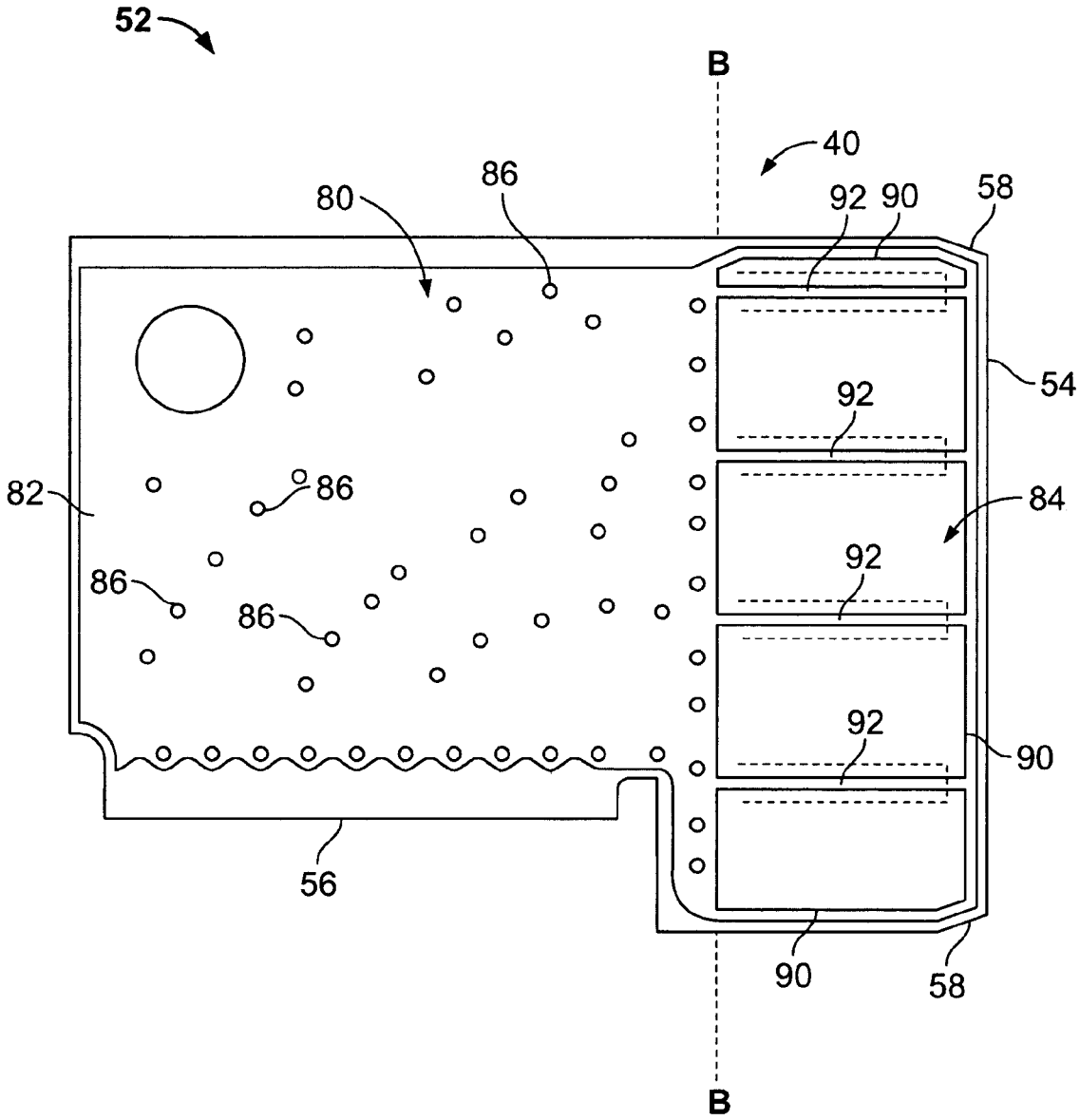
FIG. 6 is a rear view of the wafer shown in FIG. 2.

FIG. 6 is a rear view of the wafer 40 illustrating a second side 80 of the wafer 40. The second side 80 of the wafer 40 includes a ground plane 82. The ground plane 82 substantially covers the second side 80 of the wafer 40; however, for signal integrity reasons, the ground plane 82 does not extend beyond the line BB to an area 84 behind the contact pads 44, 46 on the first side 50. Extending the ground plane into the area 84 has an adverse effect on high speed signal performance. A plurality of vias 86 extend through the wafer 40 connecting the ground plane 82 with ground traces on the first side 50 of the wafer 40. The ground plane 82 provides a common ground such that there need not be a separate ground contact 62 for each ground trace 68 on the first side 50 of the wafer 40.

In order to address the vulnerability shown in FIG. 5, the wafer 40 is provided with additional ESD shielding in the form of a conductive ground trace 90 about a perimeter of the mating end 54 and located on the second side 80 of the wafer 40. The ground trace 90 traverses the perimeter of the wafer second side 80 and joins the ground plane 82 at the line BB rearward of the signal and ground contact pads 44 and 46, respectively, on the wafer first side 50. The ground trace 90 is positioned between the mating edge 54 and the signal and ground contact pads 44 and 46 on the wafer first side 50 to provide a shortened discharge path for an ESD that occurs proximate the mating end 52 of the wafer 40. In an exemplary embodiment, the ESD shielding also includes secondary ground traces 92 that are positioned on the second side 80 of the wafer 40 and behind the ground contact pads 46 on the wafer first side 50.

The traces 90 and 92 forming the ESD shielding are integrally formed on the wafer second side 80. The traces 90 and 92 are closer to the perimeter of the mating edge 54 and thus effectively shield the signal contacts 44 from ESD. In FIG. 6, the ground contact pads 46 are shown in phantom outline. The secondary ground traces 92 are aligned with the ground contact pads 46 on the first side 50. The secondary ground traces 92 extend from the perimeter trace 90 and join the ground plane 82 at the line BB which is rearward of the contact pads 44 and 46 on the first side 50 of the wafer 40. Positioning the secondary ground traces 92 behind the ground contact pads 46 does not tend to adversely affect signal performance while providing additional flow path area for the ground trace 90.

In an alternative embodiment, the wafer 40 can be formed so that the traces 90 and 92 connect to traces to separate ground contact pads rather than the ground plane 82. For example, the wafer 40 may be provided with ground contact pads to a separate ground circuit, such as a dedicated ESD ground, to which the traces 90 and 92 can connect. In an exemplary embodiment, the traces 90 and 92 are on the second side 80 of the wafer 40. Alternatively, if requirements permit, the trace 90 could be placed on the first side 50 of the wafer 40. For instance, if the connector 10 is mated only when no power is being applied, temporary grounding of the signal contacts in the mating connector would be of no concern and the ESD shielding trace 90 could be placed on the first side 50 of the wafer 40.

Returning to FIG. 1, there is obviously additional susceptibility to an ESD through the opening 30 at the first end 32 of the housing 20. The opening 30 exposes the signal traces 66 such that, if touched, ESD damage can occur. This could be prevented by covering the opening 30 with an insulator or converting the exposed wafer 40A to a ground plane wafer which effectively sacrifices the functionality of the wafer 40A, rendering the wafer 40A a protection wafer. Neither of these options are particularly attractive since either the cost, or the signal carrying capacity, or both, of the connector 10 is adversely affected. However, both are viable and may be considered in critical applications.

Figure 7:
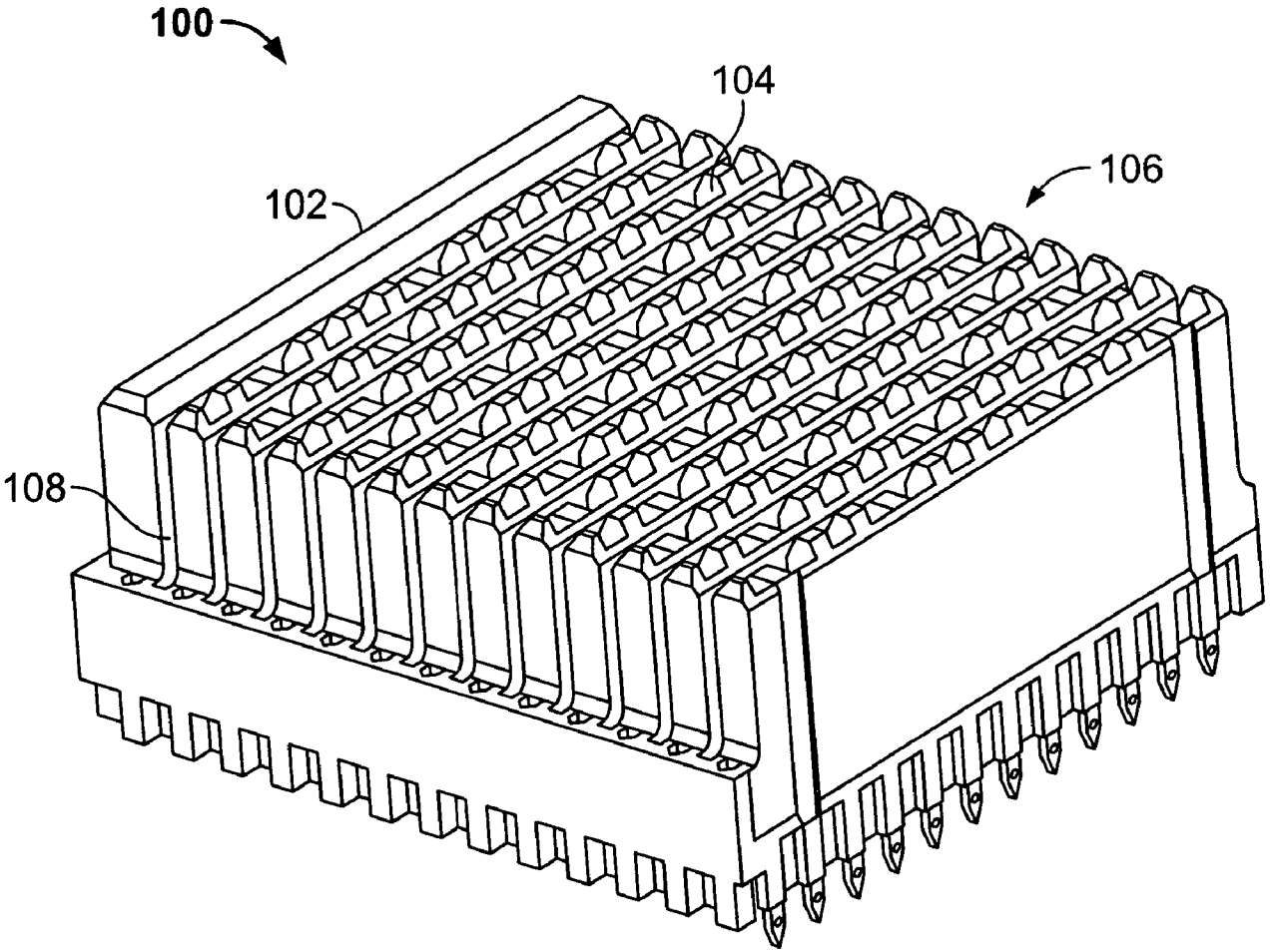
FIG. 7 is a perspective view of a header connector formed in accordance with an exemplary embodiment of the present invention.

FIG. 7 is a perspective view of a header connector 100 suitable for use with the receptacle 10. The header connector 100 is a known connector that is suitable for use on a back plane circuit board or a back plane component (not shown). The header connector 100 includes a housing 102 that holds a plurality of contacts 104, some of which are signal contacts and others of which are ground contacts, arranged in a complementary pattern to the pattern of the contact pads 44, 46 on the receptacle connector 10. The header connector 100 includes a mating face 106. The housing 102 includes a plurality of slots 108 that are configured to receive the mating edges 54 of the wafers 40 in the receptacle connector 10. Typically, the header connector is mounted such that it is less accessible than the receptacle connector 10 so that a person is less likely to touch the header connector 100. Routinely, the receptacle connector 10 is brought to the header connector 100 when the connectors 100, 10 are to be joined. As a result, damage resulting from an electrostatic discharge is of considerably less concern with regard to the header connector 100.

The embodiments herein described provide a connector with ESD protection integrally formed on each wafer in the connector. The ESD shielding is provided through the addition of a perimeter trace on the second side of the wafer that extends from the ground plane on the wafer second side. The shielding method takes advantage of the fact that the connector wafers are circuit boards so that the additional traces may be designed into the wafer layout and formed when the circuit board is etched. Thus, the integrated ESD shielding on the wafers provides ESD shielding at reduced cost and complexity in comparison to known ESD shielding techniques.

While the invention has been described in terms of various specific embodiments, those skilled in the art will recognize that the invention can be practiced with modification within the spirit and scope of the claims.

What is claimed is:

1. An electrical connector comprising:

a dielectric housing that holds a plurality of electrical wafers, each of said wafers including a first side, a second side opposite the first side, and a forward mating edge, a plurality of contact pads on the first side which are recessed from the forward mating edge, and a conductive ground trace extending along a perimeter of the mating edge, said ground trace being separately provided from said contact pads, and said ground trace being positioned closer than the contact pads to the forward mating edge.

2. The electrical connector of claim 1, wherein each of said plurality of electrical wafers includes a ground plane on said second side, said conductive ground trace being connected to said ground plane.

3. The electrical connector of claim 1, wherein said forward mating edge includes chamfered corners.

4. The electrical connector of claim 1, wherein said plurality of contact pads include signal contact pads and ground contact pads, and each said conductive ground trace is disposed on said second side and further includes secondary ground traces on said second side aligned with and extending substantially parallel to said ground contact pads on said first side, said secondary ground traces extending from said perimeter conductive trace to a ground plane on said second side of said wafer.

5. The electrical connector of claim 1, wherein each of said plurality of electrical wafers further includes a mounting edge, said mounting edge including signal contact pads and ground contact pads on said first side of said electrical wafer, said mounting edge configured to be connected to a circuit board.

6. The electrical connector of claim 1, wherein said conductive ground trace is disposed on said second side of said electrical wafer.

7. The electrical connector of claim 1, wherein said housing comprises an upper housing portion and a lower housing portion, said electrical wafers received in said lower housing portion with a card edge connection.

8. The electrical connector of claim 1, wherein said plurality of contact pads include signal contact pads and ground contact pads, said signal contact pads being rearwardly recessed from said forward mating edge relative to said ground contact pads.

9. An electrical connector comprising:

a dielectric housing including a mating face and a mounting face;

a plurality of electrical wafers held within said housing, each of said wafers including a first side, a second side opposite the first side, a mating end proximate said housing mating face, and a mounting edge proximate said housing mounting face, said mating end including signal contact pads and ground contact pads on said first side of said wafer; and an electrostatic discharge (ESD) shield integrally formed on one of the first and second sides of each said wafer, said EMI shield extending substantially adjacent and parallel to said mating end.

10. The electrical connector of claim 9, wherein said ESD shield comprises a conductive trace extending about a perimeter of said mating end of said wafer, said conductive trace joining a ground circuit on said wafer at a location rearwardly of said ground contact pads and signal contact pads.

11. The electrical connector of claim 9, wherein said ESD shield comprises a conductive trace extending about a perimeter of said mating end on said second side and a secondary conductive trace aligned with and extending substantially parallel to said ground contact pads, said secondary conductive trace extending from said ground conductive trace to a ground plane rearwardly of said ground contact pads at said mating end of said wafer.

12. The electrical connector of claim 9, wherein said signal contact pads are rearwardly recessed from a forward edge of said mating end of each said wafer relative to said ground contact pads.

13. The electrical connector of claim 9, wherein said housing comprises an upper housing portion and a lower housing portion, said electrical wafers received in said lower housing portion with a card edge connection.

14. The electrical connector of claim 9, wherein said housing comprises an upper housing portion and a lower housing portion, said upper housing portion including upper and lower shrouds proximate said mating face, said plurality of electrical wafers including mating edges that extend forwardly beyond said upper and lower shrouds.

15. The electrical connector of claim 9, wherein said signal contact pads and said ground contact pads are arranged in an alternating pattern on said plurality of electrical wafers, said signal contact pads arranged in differential pairs.

16. An electrical wafer for a connector comprising:

a planar substrate having a first side and an opposite second side;

a plurality of signal contact pads and ground contact pads located on said first side, said signal contact pads and ground contact pads each having a longitudinal axis, said longitudinal axis of each signal contact pad and ground contact pad extending generally parallel to one another and in a substantially perpendicular orientation with respect to the first edge, said first edge comprising a mating edge that defines a mating end; and an electrostatic discharge (ESD) shield integrally formed on one of said first and second sides, said ESD shield extending generally parallel to said first edge and generally perpendicular to said longitudinal axis of each of the signal contact pads and the ground contact pads, said ESD shield configured to receive an ESD before the signal contact pads and the ground contact pads.

17. The electrical wafer of claim 16, wherein said ESD shield comprises a conductive trace extending about a perimeter of said mating end, said conductive trace joining a ground plane on said second side rearwardly of said ground contact pads and signal contact pads on said first side.

18. The electrical wafer of claim 16, wherein said ESD shield comprises a conductive trace extending about a perimeter of said mating end on said second side and a secondary conductive trace aligned with said ground contact pads on said first side, said secondary conductive trace extending from said perimeter conductive trace to a ground plane rearwardly of said ground contact pads.

19. The electrical wafer of claim 16, wherein said signal contacts are rearwardly recessed from said mating edge relative to said ground contacts.

20. The electrical wafer of claim 16, wherein the ESD shield extends between respective ends of the signal contact pads and the ground contact pads along the mating edge.

* * * * *